United States Patent [19]

Kolton et al.

[11] Patent Number: 4,714,156

[45] Date of Patent: Dec. 22, 1987

[54] HANGER FOR SUSPENDERS

[75] Inventors: Chester Kolton, Westfield; Stuart S. Spater, Livingston, both of N.J.

[73] Assignee: B&G Plastics, Inc., New York, N.Y.

[21] Appl. No.: 882,486

[22] Filed: Jul. 7, 1986

[51] Int. Cl.[4] ..... A47G 25/36; A47G 25/48

[52] U.S. Cl. ..... 206/296; 206/278; 223/85; 211/113; 40/322; D6/315; D6/326

[58] Field of Search ..... 223/85, 87, 92, 93, 223/97; 211/113; 2/340; 206/278, 296; 40/322; D6/315, 326

[56] References Cited

U.S. PATENT DOCUMENTS

| | | | |
|---|---|---|---|
| D. 146,997 | 6/1947 | Townsend et al. | 223/93 X |
| 405,257 | 6/1889 | Harris | 211/113 |
| 1,885,503 | 11/1932 | Acton | 223/93 |
| 3,710,996 | 1/1973 | Smilow et al. | 223/87 |
| 4,063,669 | 12/1977 | Smilow et al. | 223/87 |
| 4,416,401 | 11/1983 | King | 223/92 X |

FOREIGN PATENT DOCUMENTS

| | | | |
|---|---|---|---|
| 809831 | 12/1936 | France | 211/113 |
| 2436276 | 5/1980 | France | 211/113 |

*Primary Examiner*—Robert R. Mackey

*Attorney, Agent, or Firm*—Robin, Blecker & Daley

[57] ABSTRACT

A display hanger for suspenders comprises a flat body having a hook portion and a lower portion. The lower portion includes a pair of elongate suspender-engaging members depending in mutually transversely spaced relation, each having an opening extending therethrough adjacent the body lower portion. Each such member is foldable upon itself and has a free end distal from the body lower portion with a projection extending therefrom. The projections are configured both to permit receipt of the suspender stems by the elongate members and to retentively reside in the elongate member openings upon folding of the members following such stem receipt.

3 Claims, 5 Drawing Figures

HANGER FOR SUSPENDERS

FIELD OF THE INVENTION

This invention relates to a hanger for releasably retaining suspenders for trousers or skirts, for display of the suspenders and of related marketing information.

BACKGROUND OF THE INVENTION

In the case of belts for trousers and skirts, it was, for many years, customary to package the belt in overlayered manner in a box-like structure having a viewing window showing the belt buckle and an adjacent limited portion of the belt. The belt was not seen in its entirety and, of course, could not be examined in full by the consumer without opening the box and removing same. Such marketing disadvantage for belts was alieviated in great measure by developments of the assignee hereof evidenced in the belt hangers of U.S. Pat. Nos. 3,710,996 and No. 4,063,669, each of which provided for hanging display of belts and for customer full examination thereof with the hanger securely attached to the buckle end of the belt and for ready rehanging thereof following examination.

Suspender marketing, as heretofore known, has been effected by box-like containing structures, providing only partial viewing of the product by the consumer or by hangers not securely attached to a suspender end. The marketing disadvantage has been akin to that of belts existing prior to the developments set forth in the above noted commonly-assigned patents.

SUMMARY OF THE INVENTION

The present invention has as its primary object to provide apparatus for effecting full display of suspenders at the point of purchase without need for removal thereof from containers.

A more particular object of the invention is the provision of a simple and effective suspender hanger which is releasably but securely attached to an extremity of the suspenders to fully display same.

Customary suspenders displayed by the hanger of the invention include two elongate strap members of elastic material, adapted respectively to traverse the shoulders of a wearer. At free ends of the strap members, each supports a pair of stems slotted to engage and retain buttons located on the interior of the trousers waistband.

In attaining the foregoing and other objects, the invention provides a display hanger for the described suspenders, comprising a flat body having a hook portion and a lower portion. The lower portion includes a pair of elongate suspender-engaging members depending in mutually transversely spaced relation, each having an opening extending therethrough adjacent the body lower portion. Each such member is foldable upon itself and has a free end distal from the body lower portion with a projection extending therefrom. The projections are configured both to permit receipt of the suspender stems by the elongate members and to retentively reside in the elongate member openings upon folding of the members following such stem receipt.

The elongate members have characteristics compatible with such stem slots and further with the thickness of the suspender stems, permitting receipt thereof.

The foregoing and other objects and features of the invention will be further understood from the following detailed description of a preferred embodiment thereof and from the drawings wherein like references numerals identify like parts and components throughout.

DESCRIPTION OF THE PREFERRED EMBODIMENT

Figure 2:
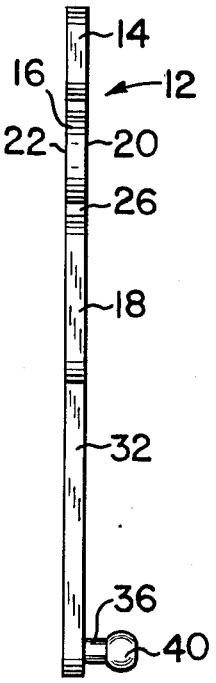
FIG. 2 is a left side elevational view of the FIG. 1 hanger.
Figure 1:
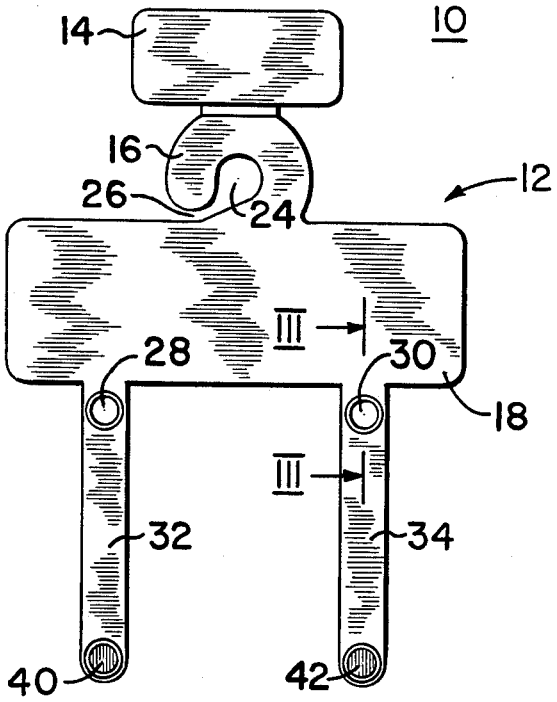
FIG. 1 is a front elevational view of a display hanger in accordance with the invention.
Figure 3:
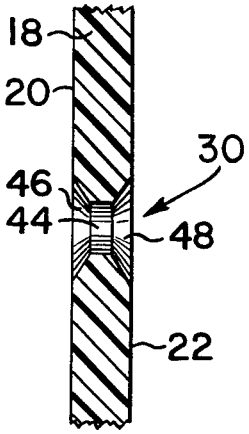
FIG. 3 is a partial and enlarged sectional view of the FIG. 1 hanger, as would be seen from plane III—III of FIG. 1.

Referring to FIGS. 1–3, hanger 10 has a molded plastic body 12 having an upper marketing information display portion 14, an intermediate hook portion 16 and a lower article engaging portion 18. Body 12 has a planar or flat front surface 20 and a planar or flat rear surface 22, thereby defining body 12 as planar.

Hook portion 16 has a central opening 24 and access passage 26 for receiving a display rod, numerous such hangers 10 thus being commonly rod-supported.

Lower portion 18 has first and second mutually transversely spaced elongate members 32 and 34, having openings 28 and 30 extending therethrough. Members 32 and 34 depend downwardly from lower portion 18 and are disposed in FIGS. 1–3 in first, unfolded disposition in the plane of body 12. Lower portion 18 desirably has its full surface expanse usable for placement of logos or the like, but may otherwise include the openings 28 and 30.

Members 32 and 34 have respective shanks 36 at the free ends thereof, and respective enlargements 40 and 42 at the ends of the shanks. The enlargements are generally spherical and of cross-section exceeding that of the shanks.

The configuration of openings 28 and 30 is seen in the enlarged partial sectional view of FIG. 3. The openings have a part 44 thereof of diameter about equal to the cross-section of shanks 36 and a tapered entry part 46 at surface 20 of larger entry diameter, about equal to that of enlargements 40 and 42. A like tapered opening part 48 is included at surface 22.

Figure 4:
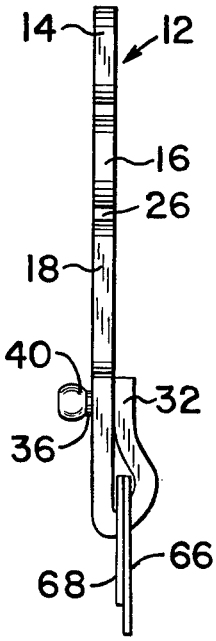
FIG. 4 is a left side elevational view of the FIG. 1 hanger, with its suspender engaging members folded into suspender retaining disposition.

Members 32 and 34 are foldable upon themselves, as is seen in FIG. 4, and are releasably retained in such folded state. Thus, as enlargements 40 and 42 are forced against the tapered entry parts of openings 28 and 30, members 32 and 34 are sufficiently elastic adjacent the openings to permit the passage of the enlargements through the body and thereupon to retentively engage back surface 22.

Figure 5:
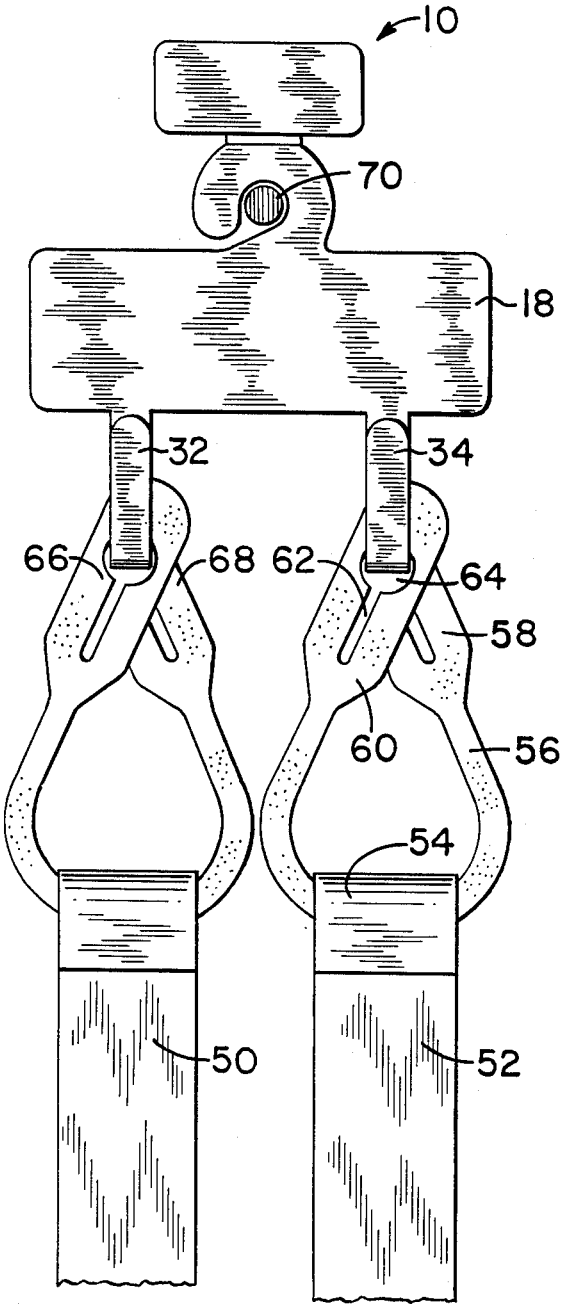
FIG. 5 is a front elevational view of the FIG. 4 showing.

Suspenders of type partly shown in FIG. 5 have straps 50 and 52. Considering strap 52, it includes an end 54 having a passage therein for supporting loopable link 56 which has stems 58 and 60. Stem 60 will be seen to have slot 62 therethrough, terminating in a circular opening 64. In customary wearing of the suspenders, buttons on the interior of the waistband of trousers are inserted into and through slot 62 such that the button stitching thread resides in opening 64 and the button lies flat with stem 58 and retains the stem and button assembly.

The dimensions of projections 40 and 42 and the cross-sectional dimensions of elongate members 32 and 34 are selected in relation to the diameter of stem openings 64 to permit assembly, as in FIGS. 4 and 5. Further, the lengths of members 32 and 34 are of course selected to permit two stems to be resident in each member, when folded, as in FIG. 4 for stems 66 and 68.

In use of the hanger, a pair of stems is applied to each of elongate foldable members and the members are then folded on themselves and their projections forced through the respective openings. The hanger may then be applied to rod 70 (FIG. 5) for display along with other likewise hung suspenders.

Various changes may be introduced in the foregoing detailed embodiment of the invention without departing from the invention. Thus, the particularly depicted and discussed embodiment is intended in an illustrative and not in a limiting sense. The true spirit and scope of the invention is set forth in the following claims.

We claim:

1. In combination, suspenders of the type having first and second straps, each strap having a pair of stems connected therewith, each stem having a slot extending therethrough for receipt of a trouser button in use of said suspenders, and a display hanger comprising an integral flat body having a hook portion and a lower portion, said lower portion including first and second mutually transversely spaced elongate members depending from said lower portion and including openings therethrough adjacent said lower portion, each said member being folded upon itself and having a projection extending therefrom, each said projection being retentively resident in said opening of said member thereof, said elongate members being configured in cross-section to permit passage thereof through said slots of a stem pair and configured in length such that two stems are resident in each said member in such folded condition.

2. The invention claimed in claim 1 where in each said projection includes a shank extending from its elongate member and an enlargement on the end of said shank, each said opening being in part of diameter about equal to the cross-sectional dimension of said shank, said body being sufficiently elastic adjacent said openings to permit passage of said enlargement therethrough to effect such retention of said enlargement.

3. The invention claimed in claim 2 wherein said body further includes a portion upwardly of said hook portion for display of marketing information.

* * * * *